US005190612A

United States Patent [19]

Orlandi

[11] Patent Number: 5,190,612

[45] Date of Patent: Mar. 2, 1993

[54] LABELING MACHINE FOR SELF-ADHESIVE LABELS

[75] Inventor: Ireneo Orlandi, San Giorgio di Mantova, Italy

[73] Assignee: Alfa Construzioni Meccaniche S.p.A., Mantova, Italy

[21] Appl. No.: 638,089

[22] Filed: Jan. 7, 1991

[30] Foreign Application Priority Data

| | | | |
|---|---|---|---|
| Mar. 6, 1990 | [IT] | Italy | 40038 A/90 |
| Dec. 28, 1990 | [DE] | Fed. Rep. of Germany | 4042100 |
| Dec. 29, 1990 | [ES] | Spain | 9100156 |

[51] Int. Cl.[5] ..... B65C 9/00

[52] U.S. Cl. ..... 156/567; 118/230; 156/568; 156/571; 156/572; 226/96

[58] Field of Search ..... 156/567, 568, 571, 572; 226/96; 118/230, 231

[56] References Cited

U.S. PATENT DOCUMENTS

| | | | |
|---|---|---|---|
| 2,769,633 | 11/1956 | Krueger | 226/96 |
| 3,923,589 | 12/1975 | Tavernier | 156/571 X |
| 4,206,012 | 6/1980 | Höveler | 156/571 |
| 4,435,246 | 3/1984 | Green | 156/542 |

*Primary Examiner*—David A. Simmons
*Assistant Examiner*—James J. Engel, Jr.
*Attorney, Agent, or Firm*—Darby & Darby

[57] ABSTRACT

In an improved machine for applying self-adhesive labels to bottles, of the type in which a set of rotating segments (1) carried on vertical shafts (7) are cycled between a magazine and a transfer station by a revolving platform (8), the design of the segment features a surface (6) with a matrix of finely pointed projections (3) by which labels are picked up from their gummed side and supported temporarily with a minimum of surface contact, such that the adhesive properties of the label remain essentially unaffected by handling.

8 Claims, 2 Drawing Sheets

LABELING MACHINE FOR SELF-ADHESIVE LABELS

BACKGROUND OF THE INVENTION

The present invention relates to an improvement in a labeling machine of the type used for affixing self-adhesive labels.

A conventional type of machine used for applying plain labels (i.e. without any adhesive coating) comprises a plurality of segments that must be made tacky initially by contact with a gumming roller, in such a way as enables them to pick up the single labels from a magazine.

The labels cling thus to the segments, with printed side uppermost, before being detached by means of grippers and applied to the respective containers as these move steadily through the machine.

Such prior art methods permit of labeling 15,000 containers per hour or thereabouts.

In certain instances, however, and especially in the case of bottles containing champagne and fine wines, use is made of self-adhesive labels in order to obviate the problems of smearing.

Using self-adhesive labels, the method by which the single label is transferred from the supply roll to the bottle differs from the method mentioned above. In machines used for affixing self-adhesive labels, in fact, the label is projected onto the bottle by a jet of air, with the bottle standing stationary and correctly positioned.

This is a method adopted for affixing labels to non cylindrical surfaces, for example the band applied to the frustoconical neck portion of a champagne bottle, and labels for shaped surfaces in general. Such a system allows of labeling some 4,000 bottles per hour only, by reason of the fact that the label is affixed with the bottle at standstill; in short, the movement of the bottles through the machine is intermittent rather than continuous.

The object of the present invention is to overcome the drawback thus outlined, and more particularly to permit of applying self-adhesive labels to the shaped surfaces of a bottle while the bottle itself is in motion, and thus achieve hourly output levels substantially on a par with those obtainable in conventional wet labeling processes.

SUMMARY OF THE INVENTION

The stated object is fully realized in a labeling machine incorporating the improvement disclosed. Such a machine comprises a plurality of segments each associated with and rotatable about the axis of a respective vertical shaft, all of which are supported by a platform rotating in turn about an axis parallel with the axes of the vertical shafts. The labels, dispensed singly from a magazine, are taken up onto the segments and transferred to sets of grippers by which they are then offered to the containers and affixed.

According to the invention, the working surface of the rotating segment, to which the self-adhesive label clings during passage from the label supply means to the grippers, affords a plurality of projections designed to reduce the area of contact between this same surface and the gummed side of the label.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
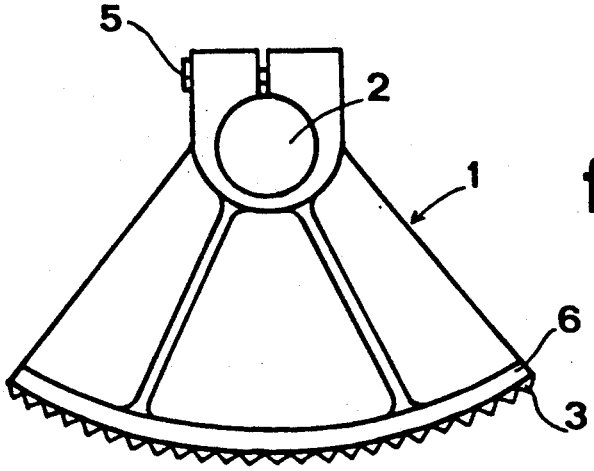
FIG. 1 illustrates one of the segments of the labeling machine, viewed in plan from above.
Figure 2:
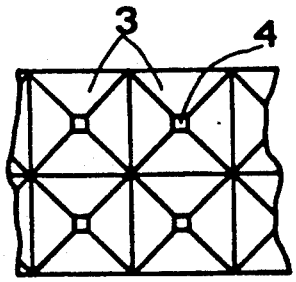
FIG. 2 shows a detail of the projections afforded by the segment, in frontal elevation.
Figure 3:
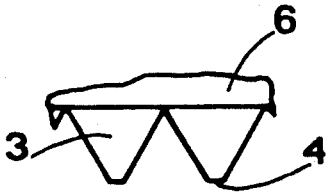
FIG. 3 shows a detail of the projections afforded by the segment, in plan from above.
Figure 4:
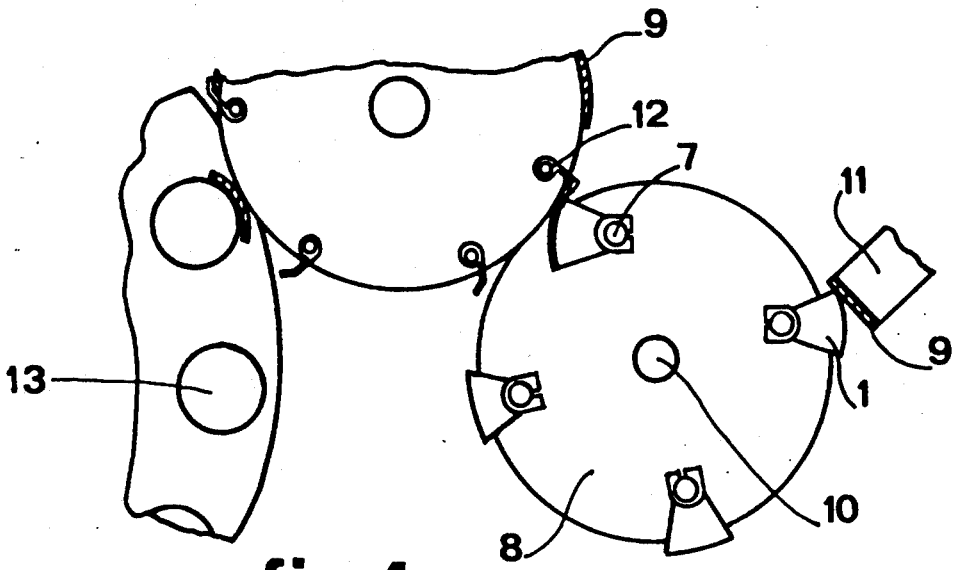
FIG. 4 is a schematic illustration of the improved labeling machine viewed in plan from above.
Figure 5:
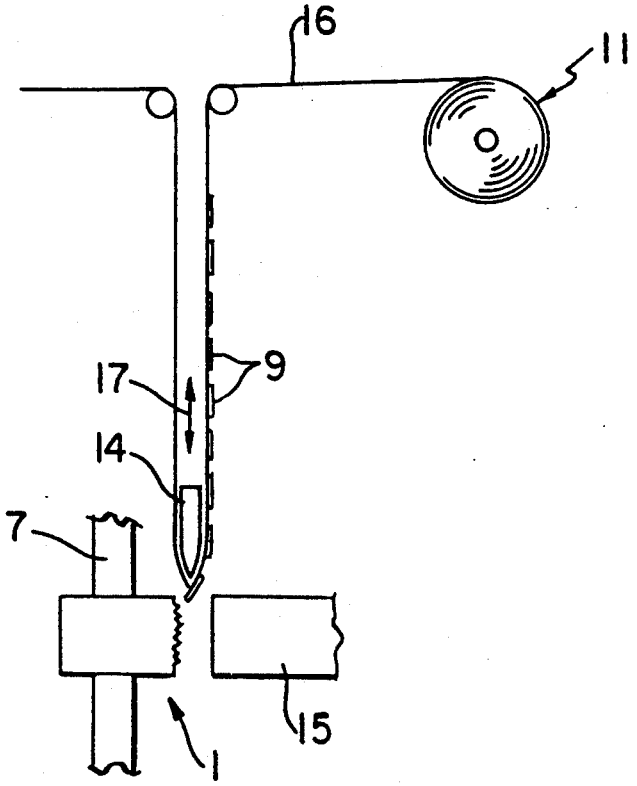
FIG. 5 shows a label supply means.

With reference to the drawings, 1 denotes a segment forming part of a machine for fixing self-adhesive labels to containers, which is mounted by way of a hole 2 to a vertical shaft 7 and rotatable thus about the axis of the shaft.

5 denotes a threaded fastener by means of which the segment 1 is clamped to the shaft 7.

The labeling machine comprises a plurality of these segments 1, the shafts 7 of which are supported by a platform 8 rotatable about an axis 10 disposed parallel to the vertical shafts themselves. 6 denotes the outermost frontal or working surface of the segment 1, positioned to interact with a labels supply means 11 from which self-adhesive labels 9 are dispensed singly an in succession; the surface 6 in question affords a plurality of frustopyramidal projections 3, each exhibiting a lesser base or apex 4 of which the working or contact surface area measures approximately 1 $mm^2$.

To all intents and purposes therefore, in view of the extremely reduced surface area of its apex 4, the single projection 3 may be considered as being pyramidal, and the contact surface substantially pointed.

The projections 3, which need occupy only that area of the segment destined to enter into contact with the surface of the label, are distributed uniformly and contiguously over the area in question.

The segments 1 are embodied in a plastics or nylon material, though alternatively, a metallic material might be adopted.

The label supply means 11 is conventional in embodiment, and designed to accommodate a continuous backing strip from which the single gummed labels are lifted by a blade (not shown) and transferred to a vacuum plate; from this plate, the label 9 will be taken up by one of the segments, its gummed side clinging to the apexes 4 of the pyramidal projections. Thus, on leaving the label supply means 11, the label 9 is supported temporarily by the projections 3. Because methods and apparatuses for applying a label to the working face of a segment are well known and ar not a novel portion of the invention, they are not described in further detail herein.

FIG. A shows a label supply means 11 and blade 14. The blade can slide vertically in the directions indicated by arrow 17. The label supply means 11 comprises a continuous backing strip 16, with attached labels, wound about a spool. The blade 14 produces an automatic detachment of the label 9 from the strip as the strip moves around the sharp edge of the blade 14. In a conventional manner, the label 9 is sucked on its non-gummed side by a vacuum plate 15 and held thereon.

The blade 14 shifts its position such that the vacuum plate 15 can then move the label to the segment 1, where the sticky side of the label attaches to the working surface of the segment 1.

Thereafter, one label is released by the segment to gripping means 12 and applied by these same means to a relative container 13 without any pause in the movement of the container as it passes through the machine.

The step of detaching the label from the segment in readiness for its application to the container is facilitated by the minimal area of contact afforded by the projections, which also enables the label to keep its adhesive properties substantially intact. Further advantage derives from the fact that the apexes or points 4 are effectively self-cleaning, any accumulations of gum tending to cling to the greater surface area of the labels.

In an alternative embodiment of the invention, the projections 3 afforded by the segment might be of shape other than pyramidal as illustrated, for example domed, whilst retaining the substantially pointed area of contact.

What is claimed is:

1. A labeling machine for transporting an applying in sequence respective labels having an adhesive coating onto a container moving in a continuous string of containers, comprising:

a platform rotatable about a first axis;

at least one segment rotatable about a respective shaft, said shaft being supported by said platform and having a second axis parallel with said first platform axis, said at least one segment having a working outer surface for engagement during use of said machine, with the adhesive surface of a respective label, said outer working surface including a plurality of projections extending away from said second axis, the outer end surfaces of said projections contacting said adhesive surface during use of said machine, the area of said contacting end surfaces being a minor portion of the outer working surface area of said at least one segment;

at least one gripping means positioned adjacent said platform for collecting, during rotation of said platform about said first axis during use of said machine, a respective label from said at least one segment, and for transporting said collected label to a position for contacting a container in said string, the motions of said platform and said at least one segment about said axes, and motion of said at least one gripping means being synchronized with container motion so as to attach a respective label to each said container in said string.

2. A labeling machine as in claim 1, wherein said projections on said segment working surface are pointed.

3. A labeling machine as in claim 2, wherein said projections are pyramidal in shape.

4. A labeling machine as in claim 1, wherein said projections on said working surface are of spherical domed shape.

5. A labeling machine as in claim 1, wherein said contact area of each said projection is substantially equal to or less than 1 $mm^2$.

6. A labeling machine as in claim 1, wherein said minor contact surface area of said projections temporarily supports said label by contact with said adhesive surface, a major portion of said adhesive surface being unaffected by such contact.

7. A labeling machine as in claim 1, wherein said projections are distributed uniformly and contiguously over the entire working surface of said at least one segment.

8. A labeling machine as in claim 1, wherein said segments are plastic.

* * * * *